US005862720A

United States Patent [19]

McNellis

[11] Patent Number: 5,862,720

[45] Date of Patent: Jan. 26, 1999

[54] BOTTLE OPENING TOOL

[75] Inventor: Kenneth M. McNellis, Clovis, Calif.

[73] Assignee: Jessie L. McNellis, Clovis, Calif.

[21] Appl. No.: 83,851

[22] Filed: May 22, 1998

Related U.S. Application Data

[63] Continuation-in-part of Ser. No. 798,028, Feb. 6, 1997, abandoned.

[51] Int. Cl.[6] ..... B67B 7/44

[52] U.S. Cl. ..... 81/3.09; 81/3.44; 81/424.5

[58] Field of Search ..... 81/3.09, 3.4, 3.44, 81/418, 419, 424.5, 3.07; 7/151, 155

[56] References Cited

U.S. PATENT DOCUMENTS 2,948,171 8/1960 Lucibello ..... 81/418

FOREIGN PATENT DOCUMENTS 997139 1/1952 France ..... 81/3.09
3410333 6/1985 Germany ..... 81/3.4
19945 of 1908 United Kingdom ..... 81/3.44

*Primary Examiner*—David A. Scherbel
*Assistant Examiner*—Joni B. Danganan
*Attorney, Agent, or Firm*—Donald W. Meeker

[57] ABSTRACT

A hand tool for removing the stopper, foil and wire basket all together simultaneously from a bottle of champagne in a safe, quick and easy manner, the tool consisting of a first and a second half. Each half provides a handle means for grasping and manipulating the tool, an angled portion at which point the halves overlap and are pivotally secured together, and one of a pair of curved gripping heads designed to engage with the stopper. Each of the gripping heads has an in facing curved surface to accommodate the stopper therebetween and a pair of elongated pointed teeth extending inwardly therefrom. The teeth on each of the gripping heads are spaced apart a sufficient distance to straddle a wire rib of the wire basket. A concave groove is positioned between each set of teeth so as to allow the teeth to penetrate and firmly grip the stopper, penetrating to the full length of each of the teeth into a cork stopper, while accommodating the ribs within the groove. The teeth penetrate into a nylon stopper by indenting the nylon stopper for a firm grip. The teeth penetrate and firmly grip the stopper at four cardinal points around the stopper to apply a torsion force to the stopper during twisting to remove the stopper and a resisting force to retain it upon release of the stopper.

17 Claims, 4 Drawing Sheets

BOTTLE OPENING TOOL

REFERENCES TO RELATED APPLICATIONS

This is a continuation-in-part application of U.S. patent application Ser. No. 08/798,028 filed Feb. 6, 1997.

BACKGROUND OF THE INVENTION

1. Technical Field

This invention relates generally to bottle openers, and more particularly to a tool for gripping and removing champagne bottle stoppers, wire baskets, and foil simultaneously with one easy twist quickly, easily and safely in such a way as to prevent the stopper from injuring anyone or damaging anything in the vicinity combined with a corkscrew with a lever arm and a bottle cap opener, thereby enabling easily removal of the stopper from a bottle of wine and the cap from virtually any type of beverage bottle.

2. Description of the Prior Art

Opening a bottle of champagne can be quite a difficult procedure, as the cork or nylon stopper in the bottle is under extreme pressure. Typically, the procedure for removing the stopper from a bottle of champagne is to remove the foil and the wire basket from around the bottle neck and then firmly grasp the stopper and force it out of the bottle with a twisting, turning or thrusting motion. Unfortunately, removing a stopper in this manner is quite difficult or even impossible for people with small hands or diminished gripping strength. More importantly, this stopper-removal procedure is also dangerous for the person removing the stopper and for any people or property nearby. Since the stopper in a properly chilled bottle of champagne is under approximately 90 pounds of pressure, when it is dislodged from the bottle neck it frequently bursts from the opener's grasp and flies erratically through the air, in some instances striking and injuring a person or damaging property. There are numerous instances in which freed stoppers have knocked out front teeth, damaged eyes and gashed foreheads so deeply that stitches were required. Stoppers have also banged up furniture and become imbedded in acoustical tile.

This problem has become so acute that most champagne bottles now contain a warning label outlining the associated dangers. In fact, many champagne makers have changed the configuration of the bottle neck and experimented with a variety of other such techniques in an attempt to reduce the dangers associated with removing the stopper. Unfortunately, these alterations have done little to reduce the danger since, no matter what the bottle configuration, the stopper is still under a great deal of pressure and thus can cause serious injury upon removal.

Not only have the difficulties in removing the stopper caused personal injury and property damage, but they have also caused an increase in the price of champagne. Because opening a bottle of champagne can cause injury, champagne makers and the restaurants that serve it face an increased chance of lawsuit, thus raising their insurance premiums and, in turn, raising the cost to the consumer. In addition, manufacturing specialty bottles or stoppers is an expensive procedure, which again translates into higher prices to the consumer.

The use of corkscrews to remove the cork in a wine bottle is well known in the art, as is the use of a bottle opener to remove the cap on beer, and soft drinks. However, corkscrews and bottle openers are not effective for use in removing champagne stoppers. Unfortunately, to date there are no tools in the prior art that are capable of easily, quickly and safely removing the stopper from a bottle of champagne.

United Kingdom Patent No. 19,945, issued in 1908 to Williams and French Patent #1,074,960, issued in 1953 to Rigolot, both provide hinged champagne openers with curved gripping heads and a top guard. The gripping jaws are jagged or roughened with undulating ridges on the curved gripping surface providing only surface texture, but they would not penetrate into the stopper for a sure-locking grip and they would not even contact the stopper surface because the ribs of the wire basket would prevent the surface of the tool from contacting the stopper, since the surface protrusions are shorter than the thickness of the ribs on a wire basket over the champagne stopper. The U.K. tool end for cutting the wire basket would produce sharp wire points which could cause injury or damage.

German Patent #655,401, issued in 1937 to Stauffer, shows a hinged gripping tool for champagne stopper removal with curved gripping heads and guards, but no protrusions on the gripping surface to penetrate the stopper for a sure grip.

French Patent #2,367,699, issued in 1978 to Ferracci and U.S. Pat. No. 2,495,308, issued in 1948 to Amigone both show hinged champagne stopper removing tools with curved gripping heads having serrations or protruding lugs. Neither patent provides a top guard to hold in the stopper at the top or long pointed teeth to penetrate the stopper. Neither patents provide sufficient length of protrusions to contact and penetrate the stopper because the ribs of the wire basket over the stopper would prevent sufficient contact of the stopper for penetration.

None of the prior art devices provide sufficiently protruding and sufficiently pointed long teeth separated by a sufficient distance with a sufficient indentation between the teeth to enable the teeth to straddle the ribs on a wire basket to permit the teeth to pierce through the foil and penetrate the stopper a sufficient distance for sure retention of the stopper afforded by such teeth in conjunction with a top guard.

None of the prior art devices provide, in combination with a champagne stopper removal device, a hook on one pivoting member which is sharp for piercing the foil to access the wire loop of the wire basket and an overlapping half of the hook on another pivoting member to close over and lock onto the wire loop in a closed ring for securing the wire loop therein enabling the twisting of the wire loop to disengage the wire basket while securely holding the wire basket and the stopper, preventing the stopper from leaving the tool should the stopper release by itself upon loosening the wire basket.

Thus there is a clear need for an inventive new tool that will allow a person to quickly remove the stopper from a bottle of champagne in such a way that the stopper remains clamped in the tool, thus preventing it from flying through the air upon removal. Such a needed device would prevent injury during stopper removal, thus making serving and drinking champagne a more enjoyable experience for everyone involved. Such a tool would also successfully remove the foil, basket and stopper from the bottle neck all with one easy twist. The present invention fulfills these needs and provides further related advantages as described in the following summary.

SUMMARY OF THE INVENTION

The present invention is a tool designed to remove the cork or nylon stopper, foil and wire basket all simultaneously from a champagne bottle in a quick, easy and safe manner.

The present invention is constructed generally of two similarly configured halves, each half having a handle means for comfortable grasping of the tool, a gripping means having gripping heads each designed to clamp firmly around a stopper and at least one pair of elongated pointed teeth in each gripping head to impale the stopper (on cork stopper and indent and grip the stopper on nylon stoppers) at four cardinal points around the stopper and provide leverage in twisting and retaining the stopper during removal, and an angled portion at which point the two tool halves are pivotally secured to one another. The angled portions are positioned between the handle and gripping heads so that when the handle means of the two halves are pivoted away from one another, the gripping heads also pivot away from one another, thus allowing the gripping heads to be easily positioned around the neck, foil, wire basket and stopper of a champagne bottle. Thus it is an object of the present invention to provide a bottle opening tool that is compact, of relatively simple construction and is quick, safe and easy to use.

It is another object of the present invention to be easy to use by people of all hand sizes. This is accomplished by designing the tool so that the handles can open far enough apart to allow the gripping heads to be easily positioned around the foil, wire basket and stopper and yet not far enough apart that it is difficult to handle the tool.

It is yet another object of the present invention to provide a tool that does not require a great deal of hand and wrist strength to properly operate. At least one pair of elongated pointed teeth in each gripping head impale the cork stopper and indent the nylon stopper at four cardinal points around the stopper for a secure grip providing leverage in twisting and retaining the stopper. The elongated pointed rigid teeth can impale the cork stopper the full length of the teeth and indent the nylon stoppers to a sufficient depth to grip the nylon stoppers firmly. Simply by pivoting the handle means toward one another, the gripping heads can be properly, firmly engaged around the stopper with the teeth gripping the stopper. Once the gripping heads are properly positioned around the stopper and the teeth engaged therein, the handle means are simply twisted and rotated slightly upward to remove the stopper from the bottle neck. In addition, the tool is designed with an overall tool length great enough to provide adequate leverage to break the seal of the tightest stopper so that even people with arthritic hands or diminished strength can easily open a bottle of champagne with the present inventive device.

It is another object of the present invention to ensure that when the stopper, which is under approximately 90 pounds of pressure, is released from the bottle, it remains engaged within the teeth, guard, and jaws of the gripping heads so that it cannot inadvertently strike someone or something. To ensure this, the teeth are designed with an elongated pyramid shape having a slightly blunted pointed tip so as to bite cleanly into the stopper and not tear it and impale the cork stopper to the full length of the teeth (and indent the nylon stopper to grip it firmly), thus entrapping the stopper with at least four teeth firmly gripping the stopper at four cardinal points around the stopper, thus encircling the stopper and ensuring that the stopper will remain clamped in the tool after removal from the bottle. Not only does the unique teeth structure of the gripping heads ensure that the stopper will remain firmly lodged within the tool, but the invention also includes a guard means in the form of a pair of inwardly protruding top retention flanges, one from each of the gripping heads, that extends over the top of the stopper when the gripping heads are properly engaged with it. The guard means encloses the stopper, along with the penetrating teeth and side force of the gripping heads, so as to further prevent the stopper from escaping the tool when it is released from the bottle.

It is another object of the present invention to ensure that the gripping heads of the invention can be easily and quickly positioned around the stopper without inadvertently biting into the wire basket or having the wire basket interfere with engagement of the teeth. To accomplish this, the teeth on each gripping head are positioned apart a greater distance that the width of the rib of the wire cage and the teeth are longer than the thickness of the rib and the foil. In addition, a concave recess or groove is positioned between each pair of teeth on each of the of the gripping heads. This configuration enables the teeth to penetrate and firmly grip the cork stopper to the full length of the teeth by providing ample space between the teeth in which to receive the ribs of the wire basket therein untouched, thus allowing the teeth to impale the cork stopper properly.

It is another object of the present invention to provide a tool that is safe both to use and to store. Not only are all of the contours of the tool smooth, but the guard means of the invention also extends over the teeth so as to prevent the teeth from scratching or scraping a user's hands or other utensils with which the tool is stored.

It is another object of the present invention to provide a means by which to ensure the tool is properly positioned around the foil, wire basket and stopper before attempting to remove them. If the tool is not properly engaged with the stopper, the stopper will not be easily removed from the bottle, and, of more concern, the tool may slip out of engagement with the stopper during the removal process and allow the pressurized stopper to escape. Thus it is important that the user be able to see when the tool is properly engaged around the stopper. The present invention is designed so that when the tool is properly engaged, the top of the stopper will sit approximately flush with the guard means. While the guard means extends far enough over the top of the stopper to ensure that the stopper does not escape, it does not extend completely over the stopper, thus allowing the user to visually ensure that the stopper is properly seated before proceeding with its removal.

It is another object of the present invention to provide a tool that is effective in removing the foil, wire basket and stopper all at the same time. Before the gripping heads of the invention can be properly positioned around the stopper and the stopper removed, the wire basket must first be loosened from around the bottle neck. The present invention provides a pointed hook on the end of one of the gripping heads that can easily pierce through the foil and engage with the loop of the wire basket. The pointed hook is angled inwardly from the first of the gripping heads and has an end point for penetrating the foil and grasping the wire loop of the wire basket. The pointed hook has an inwardly angled outer edge that mates with and fits within a matingly angled inner groove of the rounded tip on the second of the gripping heads, so that when the gripping heads are positioned in the closed position, the inner groove of the rounded tip overlaps and mates with the pointed hook, the angled outer edge of the hook resting in contact with the inner groove of the opposing rounded tip. Upon closing the gripping heads together, the angled groove of the rounded tip overlaps and engages the matingly angled outer edge of the hook to encircle the wire loop with a hook ring effect entrapping the wire loop therein, ensuring that the loop is held firmly while it is twisted and thereby loosened to disengage the wire basket from the lip of the champagne bottle. This ensures that the stopper and wire basket will be retained in the tool should the stopper release under pressure upon loosening the wire basket. This also ensures that the hook will not inadvertently snag, cut or tear anyone or anything when the tool is closed for carrying or storage. The tool can then be used to remove the stopper as described above with the hook forming a front barrier to the stopper with the gripping heads secured around the stopper, further securing the stopper within the gripping ends, at which time the foil and wire basket are also pulled from around the bottle neck. This is a dramatic improvement over traditional manual methods that require many steps to achieve the same results. This is also a significant advantage for restaurant servers and other people who open many bottles of champagne, as untwisting the wire loop often results in cuts and abrasions to the hands, and removing the foil may also further scrape the hands or damage the finger nails. By using the present invention, all major and minor injuries are completely avoided.

It is another object of the present inventive bottle opening tool to be designed specifically to conform to the shape and size of a champagne bottle stopper. This is accomplished by a slight curvature of the gripping heads combined with the use of the teeth in each of the gripping heads.

It is a related object of the present invention to provide a gripping head which is sufficiently large and teeth which are sufficiently long so that the bottle opening tool may be used effectively on three common sizes of champagne corks. The tool opens sufficiently wide to engage even the largest of the champagne corks and the teeth are sufficiently long to penetrate and firmly grip even the smallest of the champagne corks.

In brief a pair of pivoting handles operates a pair of gripping heads with a hooked pointed tip for piercing the foil and grasping and untwisting a wire loop to release a wire basket on a champagne bottle. A mating grooved tip overlaps the hooked pointed tip when the tool is closed over the wire loop forming an encircling ring around the loop to prevent it from escaping the tool.

The gripping heads comprise opposing pivotable curved gripping arms each having a top inwardly protruding retention flange or guard and with a pair of in facing teeth below and spaced apart from the guard. The elongated pointed teeth are spaced apart from each other a sufficient distance and separated by a recess or groove of sufficient depth for straddling the vertical ribs on a wire basket encasing a stopper on a champagne bottle, so that by closing the gripping heads, the teeth pierce through the foil, and impale the cork stopper to the full length of each of the teeth (indent a nylon stopper for a firm grip). Because there are at least two spaced teeth on each gripping head, the stopper is thus encircled at approximately cardinal points with elongated teeth penetrating into the stopper. The surrounding penetrating teeth not only retain the stopper, but also serve as levers all around the stopper to exert torsional force in twisting the stopper to remove it and resistant force in retaining the stopper in the tool after it is disengaged from the champagne bottle. The gripping heads securely grasps the stopper with the teeth penetrating the stopper to permit twisting the stopper to disengage it from the bottle with a simple twist and lift of the tool removing the stopper, wire basket and foil simultaneously. The tool securely clamps the stopper, wire basket and foil firmly between the two sides with the teeth imbedded and the guard on the top, thereby containing the stopper to prevent injury and damage.

The handle means of at least one of the halves is designed with a cavity in which a corkscrew and a bottle opener are positioned. The corkscrew and bottle opener are positioned in such a way that when they are not in use, the bottle opener covers the opening of the cavity, thus providing a smooth gripping surface. When it is desired to use either the corkscrew or the bottle opener, the instruments are simply pivoted into an upright position from which they can be easily accessed. Thus it is a primary object of the present invention to provide a multi-purpose tool that is capable of effectively opening all types of capped beverage bottles.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

These and other details of my invention will be described in connection with the accompanying drawings, which are furnished only by way of illustration and not in limitation of the invention, and in which drawings.

DETAILED DESCRIPTION OF THE PREFERRED EMBODIMENT

Figure 1:
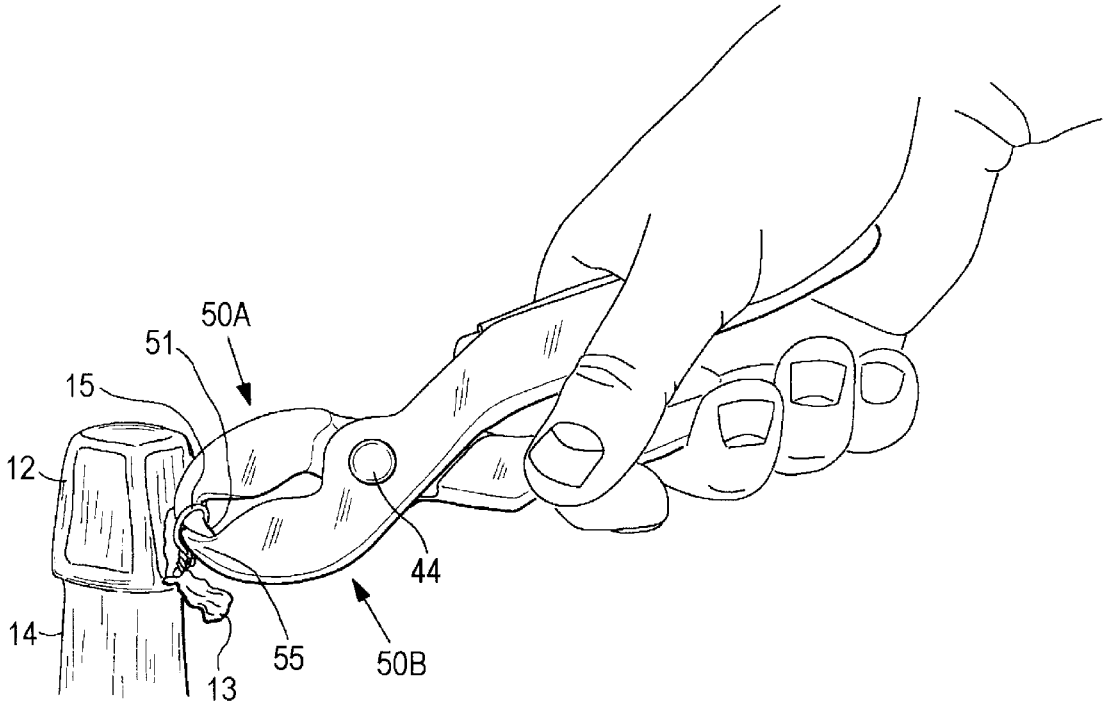
FIG. 1 is a perspective view of the preferred embodiment of the present invention, particularly showing a hook of the tool as used to pierce through a foil wrapping covering the bottle and engage with a wire loop of a wire basket.

FIGS. 1–8 show a bottle opening tool that quickly, easily and safely removes a nylon or cork stopper 11, wire basket 12, and foil 13 from a neck 14 of a champagne bottle 10 with a single twist of a user's wrist. Preferably, the overall size of the tool is approximately 7¼ inches long and ½ inch high so as to give the tool sufficient leverage to extract the stopper 11. However, the present inventive tool is by no means limited to such dimensions and may be constructed to any desired appropriate fixed length and height.

As seen in the figures, the present inventive tool consists generally of a first 20A and a second tool half 20B. Each of the tool halves 20A and 20B have a first side surface 21A and 21B (FIG. 5) respectively, and a second side surface 22A and 22B (FIG. 6) respectively. The two halves 20A and 20B are similar in shape and size, each half having an elongate, generally horizontal handle means 30A and 30B, an angled portion 40A and 40B (or pivotal portion) that extends at an approximately 45 degree angle from the handle means 30A and 30B and terminates with a curved gripping head 50A and 50B.

Figure 5:
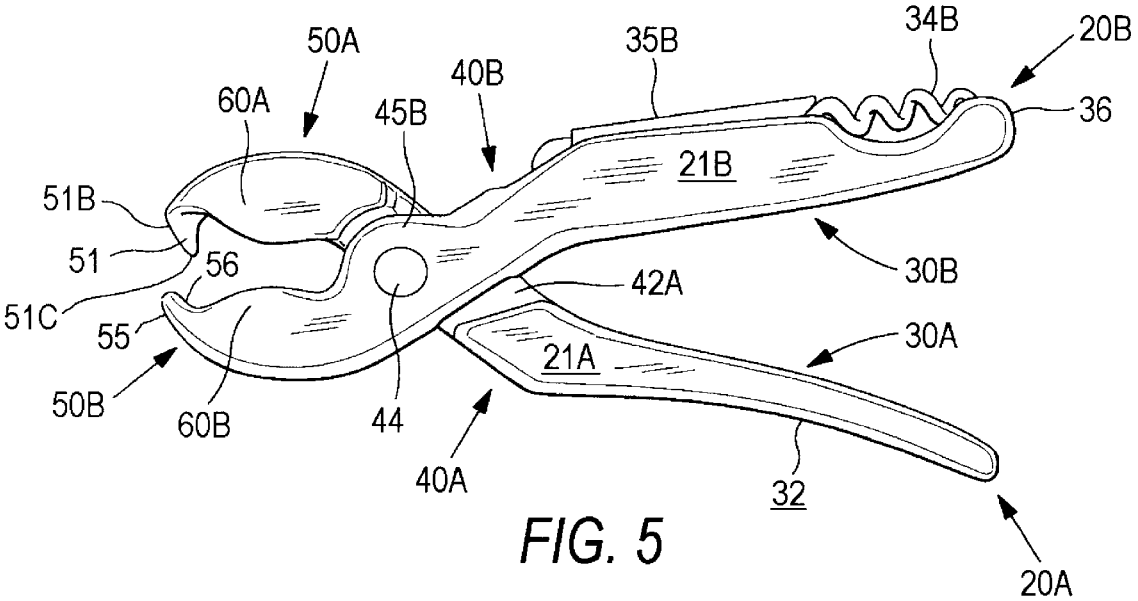
FIG. 5 is a side elevational view of the invention, particularly showing the configuration of a first side of the tool.
Figure 6:
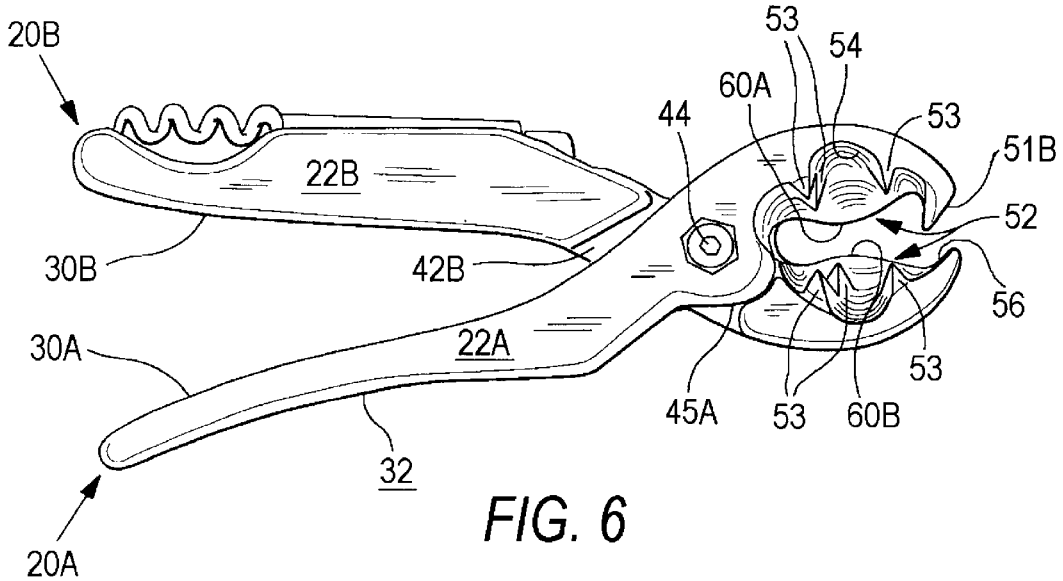
FIG. 6 is a side elevational view of the invention, particularly showing the configuration of a second side of the tool.
Figure 7:
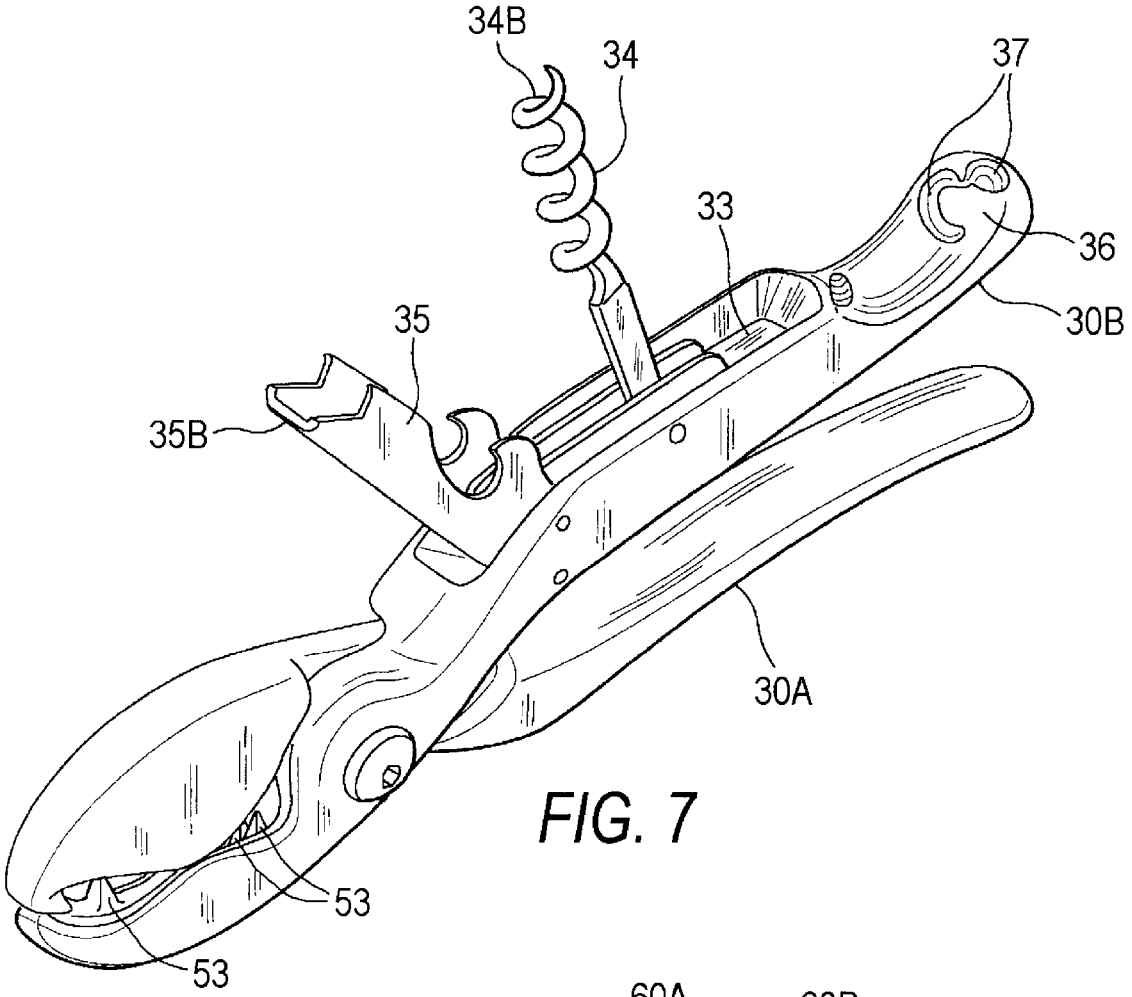
FIG. 7 is a perspective view of the invention, particularly showing the placement of a corkscrew and bottle opener in a cavity in a handle means of the invention.

As clearly seen in FIGS. 5 and 6, the handle means 30A of the first tool half 20A preferably has a slightly contoured gripping surface 32 designed to comfortably accommodate the user's palm or fingers. In the preferred embodiment, the second handle means 30B is larger than the first handle means 30A and has a cavity 33 positioned within it so as to allow for storage of a corkscrew 34 and a bottle opener 35 (FIG. 7). As illustrated, the corkscrew 34 and bottle cap opener 35 are pivotally secured within the cavity 33 so that they are pivotable between a first, closed position (FIGS. 5 and 6) and a second, upright position (FIG. 7) in which they may be used for opening various types of bottles. As seen in FIGS. 5 and 7, the corkscrew 34 and bottle opener 35 are preferably constructed and situated within the cavity 33 so that when they are in the closed position, a smooth backside 35B of the bottle opener 35 faces upwardly, thus covering the cavity 33 and providing a smooth gripping surface for a second handle means 30B at the end of the handle. As seen in FIG. 7, the second handle means 30B preferably terminates with a bulbous tip 36 having a series of grooves 37 specifically designed to accommodate an end 34B with the pointed tip of the corkscrew 34. Thus, when the corkscrew 34 is in the closed position as in FIG. 5, its end 34B extends out of the cavity 33 and rests in the grooves 37 in the bulbous tip 36 of the handle means so that the corkscrew 34 cannot scratch, scrape or otherwise injure anyone when it is not in use. Alternately, the cavity 33 may extend the entire length of the second handle means 30B, thus negating the need for the grooved bulbous tip 36. It should be noted that while these are the preferred embodiments, the present invention is by no means limited to such configurations. In alternate embodiments (not shown), both handles 30A and 30B may be constructed with a cavity 33, with a variety of other pertinent tools stored in the second cavity. In yet another embodiment, neither handle means may be constructed with a cavity 33, but rather both may have a smaller, more contoured shape so as to be easier to manipulate by people with small hands.

The angled portions 40A and 40B of the tool halves 20A and 20B extend from the handle means 30A and 30B at approximately 45 degree angles. As seen in FIG. 5, the tool is configured so that the first angled portion 40A angles upwardly from the first handle means 30A, and the second handle means 40B angles downwardly from the second handle means 30B until the two tool halves 20A and 20B overlap and ultimately cross over each other. As seen in FIG. 5, the first side surface 21 A of the first angled portion 20A has a planar, depressed surface 42A that decreases the height of the angled portion to approximately half that of the rest of the tool. Likewise, the second side surface 22B of the second angled portion 40B provides a planar, depressed surface 42B, as seen in FIG. 6. Thus, when the angled portions overlap, the planar, depressed surfaces 42A and 42B rest against one another, giving the angled portions 40A and 40B a combined height approximately equal to that of the rest of the tool. This configuration allows the tool halves 20A and 20B to overlap without adding significantly to the overall height of the tool. It also ensures that the handle and gripping heads of the tool halves align with one another in the same horizontal plane. Still further, this configuration serves to restrict the range of movement of the two halves 20A and 20B.

Figure 4:
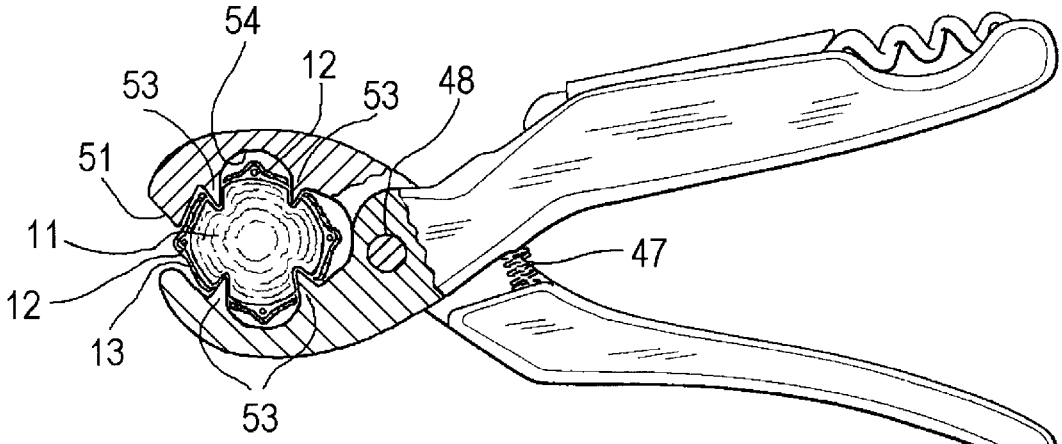
FIG. 4 is a cross-sectional view taken along line 4—4 of FIG. 3, particularly showing the encircling engagement of the gripping heads around the stopper with the teeth of the tool impaling the cork stopper at four cardinal points around the stopper.

As seen best in FIGS. 5 and 6, the two halves 20A and 20B are secured to one another at the point at which the tool halves overlap one another. The angled portions 40A and 40B of the tool halves are secured to one another by a pivotal securing means 44, such as a screw, pin, or other rigid shaft or the like pivotally connecting the two halves 20A and 20B through an opening 48 (as seen in FIG. 4) in each of the angled portions 40A and 40B. Thus, when the handles are pivoted away from one another, the gripping heads also move away from one another into an open position, and when the handles are pivoted toward one another, the gripping heads also move toward one another into a closed position. The range of motion of the handles, and thus the gripping heads, is limited by the length of the depressed surfaces 42A and 42B. In one embodiment, a tension means 47 (as seen in FIG. 4), such as a spring, is positioned between the two angled portions 40A and 40B just before they overlap one another so that the handle means 30A and 30B are biased to naturally remain a certain distance from one another. Each of the angled portions 40A and 40B of the invention preferably have a convex protrusion 45A and 45B (as seen in FIGS. 5 and 6) that allows a larger securing means 44 to be implemented without compromising the strength of the invention.

The gripping means comprises gripping heads 50A and 50B which curve outwardly from the angled portions 40, thus having a generally semi-circular configuration capable of surrounding and enclosing the stoppered bottle of champagne 10, as seen in FIG. 4.

Figure 2:
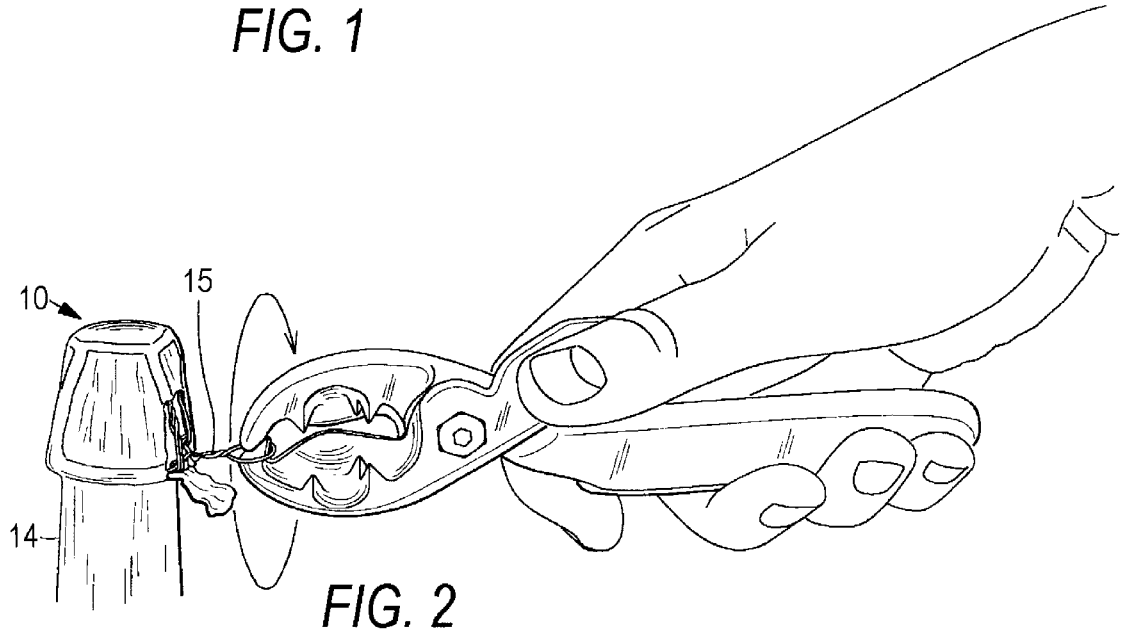
FIG. 2 is a perspective view of the invention of FIG. 1, particularly showing the tool engaged around the wire loop as used to twist the wire loop so as to loosen the wire basket from around the neck of the bottle.

As seen in FIGS. 4 and 6, each of the gripping heads has an in facing surface 52 with at least two elongated pointed teeth 53 spaced apart. While a pair of teeth 53 on each gripping head works well, more teeth may be added by pairing each of the teeth with an additional tooth immediately adjacent to and above each of the pair of teeth, as seen in FIGS. 2, 6, and 7. The additional teeth add to the gripping and retaining power of the tool to insure that the stopper is retained between the gripping heads.

The teeth 53 themselves preferably have a generally elongated pyramid shape with a sharp pointed tip which is slightly blunted by a single abrasion by sanding or filing of the sharp point to prevent injury and prevent tearing the stopper, so that the stopper cannot tear itself out of the grip of the tool. Each tooth should be longer than the thickness of the rib of the wire basket 12 and the foil 13, at least ⅛ inch and preferably ¼ inch to ½ inch long and 3⁄16 inch to ⅝ inch wide at the base tapering to a point, to allow penetration of each tooth into the stopper a sufficient depth to retain the stopper free from motion within the grasping heads and provide leverage in twisting the stopper.

The teeth are spaced apart by a distance at the base of the teeth which is greater than the width of the rib of the wire basket 12, at least 3⁄16 inch and preferably ½ inch to insure that the teeth will clear the rib and penetrate and firmly grip the cork stopper to the full length of each of the teeth (penetrating into a nylon stopper by indenting it a sufficient depth for a firm grip). The spacing between the points of the teeth on each gripping head is preferably equal to ½ the diameter of the stopper at the point where the teeth encircle the stopper, which is ⅝ inch to enable the teeth to penentrate the stopper at four cardinal points around the stopper. As seen in FIG. 4, a concave groove 54 or recess is positioned between each pair of teeth 53 to receive the rib of the wire basket therein without contact by the teeth or the gripping head to ensure that the teeth 53 are able to sink into the cork stopper 11 to the full length of each of the teeth without being constricted by the rib of the wire basket. The concave groove 54 between the teeth should be greater in depth than the thickness of the foil 13 and the rib of the wire basket 12, at least 3/16 inch from the base of the teeth and preferably ¼ inch from the base of the teeth (which is preferably ½ inch from the point of the teeth) to insure full penetration of the teeth into the cork stopper. It should be noted that while these are the preferred embodiments, the present invention is by no means limited to such configuration.

The teeth 53 are engineered so that the tool will penetrate into the stopper 11, compressing the stopper material to form a hole for each of the teeth without tearing the stopper, to secure it within the grasping heads with a firm grip so that the tool may be turned with a twist of the wrist to remove the stopper and retain the stopper within the grasping head to prevent the stopper from flying in the air and thereby preventing injury and damage. Because of the shape and length and slightly blunted point, the teeth 53 will not tear or damage the stopper in any way, thereby holding the stopper securely with the teeth remaining in the stopper during the removal procedure providing tortional leverage during twisting of the stopper and resistive leverage to retain the stopper upon release of the stopper from the champagne bottle.

As seen in FIG. 5, the in facing surface 52 of the first of the gripping heads 50A terminates with a hook 51 that extends inwardly toward the second of the gripping heads 50B. The hook 51 is angled inwardly from the gripping head 50A and has an end point 51 C for piercing the foil 13 and grasping the wire loop 15 of the wire basket 12, as shown in FIGS. 1 and 2. The hook 51 has an inwardly angled outer edge 51 B that mates with and fits within the matingly angled inner groove 56 of the rounded tip 55 on the other gripping head 50B so that when the gripping heads are positioned in the closed position, the inner groove 56 of the rounded tip 55 of the second of the gripping heads 50B overlaps and mates with the hook 51, the outer edge 51 B of the hook 51 resting in contact with the inner groove 56 of the rounded tip 55 of the second of the gripping heads 50B. Upon closing the gripping heads together, the angled groove 56 of the rounded tip 56 overlaps and engages the matingly angled hook 51 to encircle the wire loop 15 with a hook ring entrapping the wire loop therein, ensuring that the loop 15 is held firmly while it is twisted and thereby loosened to disengage the wire basket from the lip of the champagne bottle. This ensures that the stopper and wire basket will be retained in the tool should the stopper release under pressure upon loosening the wire basket. This also ensures that the hook 51 will not inadvertently snag, cut or tear anyone or anything when the tool is closed for carrying or storage. In addition, as seen in FIG. 4, the hook 51 assists in retaining the stopper within the grasping heads during removal of the stopper to prevent premature ejection of the stopper to escape the gripping heads and do damage to anyone or anything.

Figure 3:
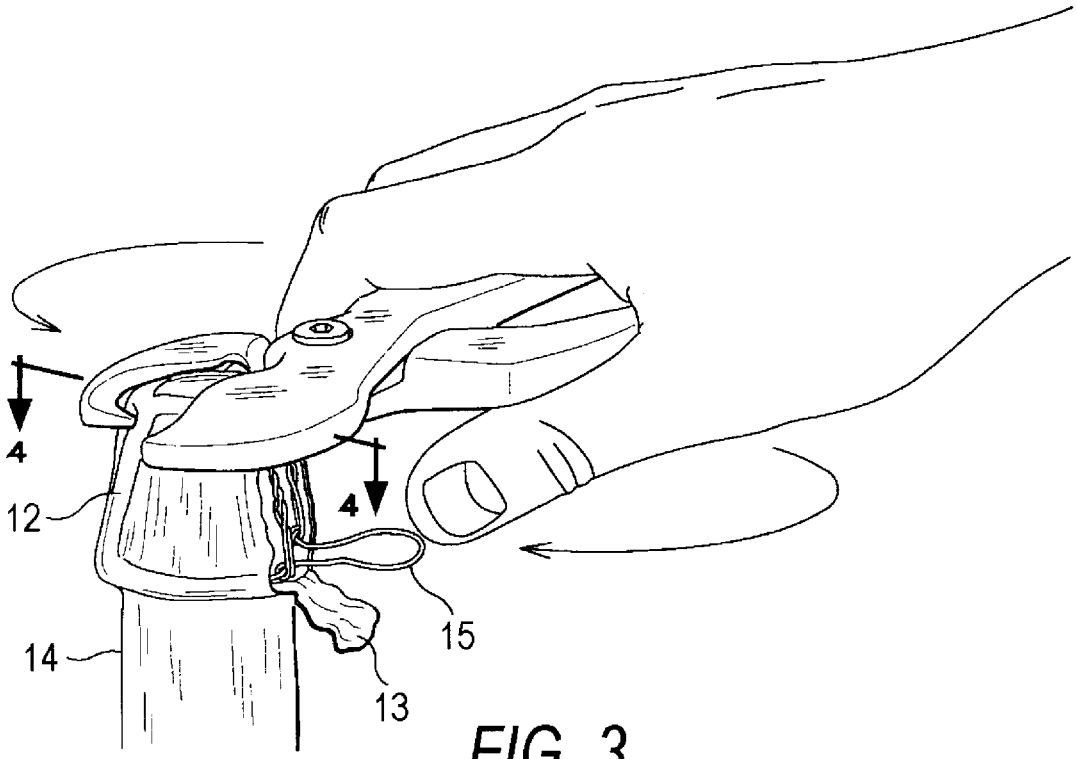
FIG. 3 is a perspective view of the invention of FIG. 1, particularly showing the tool as used to engage the foil, wire basket, and stopper and remove them all together simultaneously from the bottle with a twisting movement.
Figure 8:
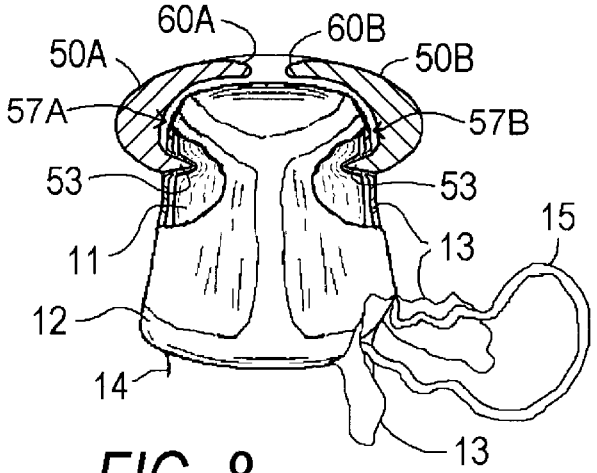
FIG. 8 is an elevational view in partial section of the stopper, wire basket, and foil showing how the invention captures them between the gripping sides with the teeth penetrating the stopper and the top guard further retaining them.

As seen in FIG. 5, the first side surfaces 21A and 21 B of the gripping heads 50A and 50B each form a top inwardly protruding retention flange or guard 60A and 60B respectively that cover the teeth 53. As in FIG. 6, the guards are large enough to extend beyond the teeth 53 so as to prevent them from being contacted by the hands of the user, and yet, as seen in FIG. 3, they are not large enough to contact one another when the tool is in the closed position. The guards are spaced away from the teeth a sufficient distance forming a stopper portion retaining recess 57A and 57B therebetween as seen in FIG. 8, to enable the teeth to penetrate and firmly grip the stopper at a point on the stopper sufficiently distant from the top of the stopper so that the stopper portion retaining in the stopper portion retaining recess 57A and 57B between the teeth and the guard is sufficiently thick that it will not tear away and the stopper will be firmly retained in the tool. The distance from the guard to the base of the teeth should be at least ¼ inch and preferably ½ inch. This allows the guards 60A and 60B to envelop the stopper 11 to further prevent it from escaping once it is freed from the bottle while still enabling the user to observe the stopper 11 and ensure that the tool is properly seated before attempting removal. While this is the preferred embodiment, the tool is by no means limited to such configuration, as there are many other guard means well known in the art that could also be implemented in the present invention.

Thus, to use the present inventive bottle opening tool, the handle means 30A and 30B are simply grasped in the hand of the user and the hook 51 is pierced through the foil 13 and engaged around the loop 15 of the wire basket 12, as seen in FIG. 1. With the gripping heads 50A and 50B positioned in the closed position so that the loop 15 cannot slide off of the hook 51, the loop 15 is rotated until the wire basket 12 is loosened from its position around the bottle neck 14 so that the stopper 11 can be removed, as seen in FIG. 2.

To remove the stopper 11, the gripping heads 50A and 50B are moved into the open position and placed on either side of the stopper 11. Once positioned on either side, the handle means are squeezed together, moving the gripping heads into the closed position around the stopper 11 (as seen in FIGS. 3, 4, and 8), the teeth 53 biting firmly into the stopper 11. When properly positioned, the top of the stopper 11 will be flush against the guards 60A and 60B, as seen in FIG. 8. When the user is sure that the tool is properly positioned, a quick twist in either direction combined with a slight upward motion removes the foil 13, the wire basket 12 and the stopper 11 all at once. Although the stopper 11 is under extreme pressure, the top guards 60A and 60B, the compressing force of the gripping heads 50A and 50B, and the locked-in penetration of the teeth 53 within the stopper combine to prevent the stopper, wire basket, and foil from escaping the tool and injuring someone.

When it is desired to use the corkscrew 34 or bottle cap opener 35, they are simply pivoted out of the cavity 33 in the handle means and into the upright, easily accessible position and pivoted back into the cavity 33 when finished.

The tool may be fabricated of metal, molded plastic, or other rigid material for strength and durability.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A hand tool for removing a stopper, a foil and a wire basket having a series of vertical spaced wire ribs and a wire loop, all together simultaneously, from a bottle of champagne, the tool comprising:

a first half and a second half and a pivot means pivotally connecting the two halves, each half comprising a rigid elongated element having a handle portion at one end configured for manually grasping and manipulating the tool, one of a pair of opposing gripping heads at the other end configured with a gripping means for engaging the stopper, foil, and wire basket of the bottle of champagne between the pair of gripping heads, and a pivot portion between the handle and the gripping heads, at which pivot portion the two halves overlap and are pivotally secured together by the pivot means so that pivoting the handle portions apart pivots the gripping heads apart to admit the stopper, foil, and wire basket therebetween and pivoting the handle portions closer together engages the gripping heads with the stopper, foil, and wire basket to secure them within the tool so that turning the tool and pulling at the stopper releases the stopper, foil, and wire basket all together simultaneously from the bottle;

the gripping means comprising a semi-circular configuration on each of the gripping heads on each of the two halves, the semi-circular configuration capable of surrounding and enclosing the stopper, foil, and wire basket, the gripping means further comprising a lower side surface facing the stopper and an upper side surface facing away from the stopper on each of the gripping heads and a pair of elongated pointed teeth protruding inwardly from the semi-circular configuration on each of the gripping heads adjacent to the lower side surface, the pair of teeth spaced apart a sufficient width to straddle a vertical rib of the series of vertical ribs of the wire basket, each of the pair of teeth being sufficiently long to pierce the foil and penetrate and firmly grip the stopper while straddling the vertical rib, the teeth capable of penetrating the stopper a sufficient distance to enable the teeth to exert a torsion force on the stopper to twist the stopper when the tool is twisted and a resisting force when the stopper is released to retain the stopper within the tool, and each of the gripping heads further provided with a recess sufficiently deep between the pair of teeth to enable the teeth to penetrate into the stopper while the rib of the wire basket fits in the recess, and the gripping means further comprising a guard in the form of an inwardly protruding retention ledge on the upper side surface on each of the gripping heads, the guard spaced apart from the pair of teeth, providing a stopper portion retaining recess between a lower surface of the guard and an upper surface of the teeth to retain a portion of the stopper therein, so that with the pair of teeth piercing the foil and penetrating the stopper while straddling the rib of the wire basket, the guard is capable of resting on top of the stopper, foil, and wire basket, so that the guards, the teeth, and the semicircular arms are capable of acting cooperatively to twist the stopper to remove it from the bottle and to retain the stopper, foil, and wire basket within the gripping heads of the tool and prevent the stopper, foil, and wire basket from escaping the tool.

2. The tool of claim 1 wherein each of the teeth is configured in a generally elongated pyramid shape with a sharp pointed tip which is slightly blunted by a single abrasion of the sharp point to prevent injury and prevent tearing the stopper.

3. The tool of claim 2 wherein each of the teeth is longer than the thickness of the rib of the wire basket and the foil.

4. The tool of claim 2 wherein the pair of teeth is spaced apart by a distance equal to half the diameter of the stopper.

5. The tool of claim 1 wherein the stopper is a cork stopper and the recess is sufficiently deep to enable penetration of each of the teeth into the cork stopper to the full length of each of the teeth.

6. The tool of claim 1 further comprising at least one additional tooth on each of the gripping heads positioned immediately adjacent to and above one of the pair of teeth, thereby adding to the gripping and retaining power of the tool.

7. The tool of claim 1 wherein the guard intrudes inwardly a greater distance than the pair of teeth so that the teeth are not exposed when the tool is stored with the guard facing upwardly, and the guard of one of the two halves does not fully mate with the guard of the other of the two halves so that with the tool engaged around the wire basket, foil, and stopper, a portion of the wire basket, foil, and stopper is visible between the two guards to insure proper engagement of the tool.

8. The tool of claim 1 further comprising a hook means at the gripping head end of at least one of the halves, the hook configured to engage the loop of the wire basket so that closing the gripping heads secures the loop and enables the tool to be twisted to unwind the wire basket and loosen it from around the neck of the champagne bottle.

9. The tool of claim 8 wherein the hook means comprises a first of the gripping heads terminating in a pointed hook that angles inwardly toward the second of the gripping heads, the hook having an end point for penetrating the foil and grasping the wire loop of the wire basket, the hook having an inwardly angled outer edge and the second of the gripping heads terminating in a rounded tip having a matingly angled inner groove so that when the gripping heads are pivoted together, the inner groove of the rounded tip overlaps and mates with the hook, the outer edge of the hook resting in contact with the inner groove of the rounded tip forming a closed ring, so that the closed ring is capable of encircling the wire loop and entrapping the wire loop therein, the tool being capable of twisting the wire loop to loosen the basket, the rounded tip being capable of shielding the hook when the gripping heads are closed together during transportation and storage of the tool.

10. The tool of claim 1 wherein the pivot portion of each half comprises a flat surface recessed from the handle to accommodate the flat surface of the other half so that as the two halves pivot through a range of motion, the range of motion is restricted by the length of the pivot portion between the handle portions of the two halves which act as a stop to the pivoting.

11. The tool of claim 10 wherein the pivot portion extends inwardly from the handle portion at a 45 degree angle.

12. The tool of claim 10 wherein the pivot portion of each of the two halves is provided with an opening therethrough and the pivot means comprises a rigid shaft through each opening pivotally connecting the two halves.

13. The tool of claim 1 further comprising a tension means connected between the first and second half for biasing the handle portions to remain apart.

14. The tool of claim 1 wherein at least one half is provided with a recess in the handle portion to accommodate at least one additional tool pivotally housed within the recess.

15. The tool of claim 14 wherein the at least one additional tool comprises a cork screw.

16. The tool of claim 14 wherein the at least one additional tool comprises a bottle cap opener.

17. A hand tool for removing a stopper, a foil and a wire basket having a series of vertical spaced wire ribs and a wire loop, all together simultaneously, from a bottle of champagne, the tool comprising:

a first half and a second half and a pivot means pivotally connecting the two halves, each half comprising a rigid elongated element having a handle portion at one end configured for manually grasping and manipulating the tool, one of a pair of opposing gripping heads at the other end configured with a gripping means for engaging the stopper, foil, and wire basket of the bottle of champagne between the pair of gripping heads, and a pivot portion between the handle and the gripping heads, at which pivot portion the two halves overlap and are pivotally secured together by the pivot means so that pivoting the handle portions apart pivots the gripping heads apart to admit the stopper, foil, and wire basket therebetween and pivoting the handle portions closer together engages the gripping heads with the stopper, foil, and wire basket to secure them within the tool so that turning the tool and pulling at the stopper releases the stopper, foil, and wire basket all together simultaneously from the bottle;

the gripping means comprising a semi-circular configuration on each of the gripping heads on each of the two halves, the semi-circular configuration capable of surrounding and enclosing the stopper, foil, and wire basket, the gripping means further comprising a lower side surface facing the stopper and an upper side surface facing away from the stopper on each of the gripping heads and a pair of elongated pointed teeth protruding inwardly from the semi-circular configuration on each of the gripping heads adjacent to the lower side surface, the pair of teeth spaced apart a sufficient width to straddle a vertical rib of the series of vertical ribs of the wire basket, each of the pair of teeth being sufficiently long to pierce the foil and penetrate and firmly grip the stopper while straddling the vertical rib, the teeth capable of penetrating the stopper a sufficient distance to enable the teeth to exert a torsion force on the stopper to twist the stopper when the tool is twisted and a resisting force when the stopper is released to retain the stopper within the tool, and each of the gripping heads further provided with a recess sufficiently deep between the pair of teeth to enable the teeth to penetrate into the stopper while the rib of the wire basket fits in the recess, and the gripping means further comprising a guard in the form of an inwardly protruding retention ledge on the upper side surface on each of the gripping heads, the guard spaced apart from the pair of teeth so that with the pair of teeth piercing the foil and penetrating the stopper while straddling the rib of the wire basket, the guard is capable of resting on top of the stopper, foil, and wire basket, so that the guards, the teeth, and the semicircular arms are capable of acting cooperatively to twist the stopper to remove it from the bottle and to retain the stopper, foil, and wire basket within the gripping heads of the tool and prevent the stopper, foil, and wire basket from escaping the tool;

a hook means at the gripping head end of at least one of the halves, the hook configured to engage the loop of the wire basket so that closing the gripping heads secures the loop and enables the tool to be twisted to unwind the wire basket and loosen it from around the neck of the champagne bottle;

wherein the hook means comprises a first of the gripping heads terminating in a pointed hook that angles inwardly toward the second of the gripping heads, the hook having an end point for penetrating the foil and grasping the wire loop of the wire basket, the hook having an inwardly angled outer edge and the second of the gripping heads terminating in a rounded tip having a matingly angled inner groove so that when the gripping heads are pivoted together, the inner groove of the rounded tip overlaps and mates with the hook, the outer edge of the hook resting in contact with the inner groove of the rounded tip forming a closed ring, so that the closed ring is capable of encircling the wire loop and entrapping the wire loop therein, the tool being capable of twisting the wire loop to loosen the basket, the rounded tip being capable of shielding the hook when the gripping heads are closed together during transportation and storage of the tool.

* * * * *